US005902355A

United States Patent [19]

Kurahasi et al.

[11] Patent Number: 5,902,355

[45] Date of Patent: May 11, 1999

[54] METHOD FOR PATTERN DYEING OF TEXTILE FABRICS CONTAINING BLENDS OF CELLULOSE REGENERATED FIBER

[75] Inventors: Ituo Kurahasi; Hiroaki Tanibe, both of Shizuoka-ken; Kikuo Kakizaki, Osaka-fu; Makoto Kawamura, Wakayama-ken, all of Japan

[73] Assignee: Fuji Spinning Co., Ltd., Tokyo, Japan

[21] Appl. No.: 09/053,079

[22] Filed: Apr. 1, 1998

Related U.S. Application Data

[63] Continuation-in-part of application No. 08/843,701, Apr. 16, 1997, abandoned.

[30] Foreign Application Priority Data

Oct. 9, 1996 [JP] Japan ..... 8-287580

[51] Int. Cl.[6] ..... D06P 3/86; D06P 3/87; D06P 5/22

[52] U.S. Cl. ..... 8/478; 8/529; 8/539; 8/654; 8/481; 8/921; 8/596; 8/541

[58] Field of Search ..... 8/529, 539, 654, 8/478, 481, 921, 596, 541

[56] References Cited

U.S. PATENT DOCUMENTS

| | | |
|---|---|---|
| 1,398,357 | 11/1921 | Briggs et al. . |
| 1,812,557 | 6/1931 | Roberts . |
| 1,913,410 | 6/1933 | Pevat . |
| 2,105,509 | 1/1938 | Schwartz . |
| 2,430,153 | 11/1947 | Womble et al. . |
| 3,019,119 | 1/1962 | Hoffman, Jr. et al. . |
| 4,410,652 | 10/1983 | Robinson et al. . |
| 4,424,061 | 1/1984 | Shimohiro et al. . |
| 4,711,640 | 12/1987 | Harper, Jr. . |

FOREIGN PATENT DOCUMENTS

| | | |
|---|---|---|
| 57-19207 | 4/1982 | Japan . |
| 54474 | 1/1993 | Japan . |
| 8-158263 | 6/1996 | Japan . |

OTHER PUBLICATIONS

JAPIO and INPADOC abstracts and citations of JP 8158263 (Jun. 18,1996).

*Primary Examiner*—Margaret Einsmann
*Attorney, Agent, or Firm*—Birch, Stewart, Kolasch & Birch, LLP

[57] ABSTRACT

A method for dying-finishing of textile fabrics which contain modified cellulose regenerated fiber capable of dyeing with cationic dyes which contains an insoluble polymer which is obtained by cross-linking a dihydroxydiphenylsulfone-sulfonate condensate with epoxy compounds having at least two epoxy groups in the molecule, and at least one kind of fiber selected from ordinary cellulose regenerated fiber, cotton and wool, the method comprising steps of dying of the textile fabrics containing modified cellulose regenerated fiber with a dyeing solution containing cationic dyes alone or containing the cationic dyes and dyes other than cationic dyes by one-bath dying method, concentration of the cationic dyes being decided for the modified cellulose regenerated fiber weight and concentration of the dyes other than cationic dyes being decided for the whole weight of the textile fabric, treating the dyed textile fabric sequentially with an aqueous solution of tannic acid for applying tannic acid 1.5–7% of the weight of the modified cellulose regenerated fiber, and after that treating it with an aqueous solution of tartar emetic for applying tartar emetic 0.5–2.5% of the weight of the modified cellulose regenerated fiber.

3 Claims, No Drawings

METHOD FOR PATTERN DYEING OF TEXTILE FABRICS CONTAINING BLENDS OF CELLULOSE REGENERATED FIBER

This application is a continuation-in-part of application Ser. No. 08/843,701 filed on Apr. 16, 1997, now abandoned, the entire contents of which are hereby incorporated by reference.

BACKGROUND OF THE INVENTION

1. Field of the Invention

The present invention relates to a method for pattern dyeing of the textile fabrics containing specific modified cellulose regenerated fiber to obtain the sprinkly pattern, dungaree pattern, chambray pattern, check pattern, or stripy pattern having a good tone, without causing soiling to the undyed part, deformation, uneven dyeing, and blurring. This method is adequately applied to clothes.

2. Related Art Statement

Cellulose fiber generally exhibits good dyeability for direct dyes and reactive dyes but exhibits little dyeability for cationic dyes. There has long been a strong desire for the application of cationic dyes to cellulose fiber because of their bright color development. Attempts have been made to introduce acidic groups into cellulose fiber to make it dyeable with cationic dyes.

For example, Japanese Patent Publication No. 19207/1982 discloses the introduction of aromatic acyl groups or aromatic sulfonic groups into the surface of cellulose fiber by the aid of aromatic carboxylic acid or aromatic sulfonic acid. The thus modified cellulose fiber is dyeable with cationic dyes in the presence of an anionic surface active agent having a sulfate ester group or a sulfonic acid group. This method, however, needs complicated steps for the direct chemical modification of cellulose molecules of cellulose fiber. In addition, the resulting modified cellulose fiber loses the hand and moisture absorption inherent in cellulose fiber. Futhermore, in the case of dark color dyeing, the introduction of aromatic acyl groups or aromatic sulfonic groups on the surface of cellulose fiber poses a problem with color fastness, especially to light and washing.

Japanese Patent Publication No. 4474/1993 discloses the modification of cellulose regenerated fiber. This modification is accomplished by treating cellulose regenerated fiber or textile fabric which contains 0.1–20 wt % of polystyrene sulfonate having a molecular weight of 1,000–2,000,000, with an aqueous solution of tannic acid before or after dyeing with cationic dyes. The disadvantage of this method is that the dyed product is practically poor in color fastness because tannic acid is simply attached to the surface of fiber.

There has been a strong demand for piece dyeing capable of dyeing textile fabrics in a desired color pattern by one-bath dyeing because the current dyeing method does not meet requirement for a large variety of products in small lots and for quick delivery. At present, shirts and pants having the sprinkly pattern, dungaree pattern, chambray pattern, check pattern, or stripy pattern are produced by weaving or knitting previously dyed yarns and bleached yarns of cotton or ordinary cellulose regenerated fiber.

It is known that textile fabrics of cotton or ordinary cellulose regenerated fiber are superior in hand and moisture absorption to those of synthetic fiber but suffer the disadvantage of being liable to wrinkling and shrinking upon washing.

It has been disclosed (in Japanese Patent Laid-open No. 158263/1996) that an insoluble polymer which is obtained by cross-linking a dihydroxy-diphenylsulfone-sulfonate condensate with epoxy compounds having at least two epoxy groups in the molecule, is incorporated into cellulose viscose immediately before spinning. It is possible to obtain modified cellulose regenerated fiber which has a practically sufficient strength without any loss of hand and moisture absorption inherent in cellulose regenerated fiber and which exhibits good dyeability for cationic dyes and good color fastness.

However, this finding did not lead to the one-bath dyeing method for imparting the sprinkly pattern, dungaree pattern, chambray pattern, check pattern, or stripy pattern to textile fabrics containing modified cellulose regenerated fiber, nor did it lead to the pattern dyeing method for producing textile fabrics having good color fastness for cationic dyes, having good wash-and-wear properties, having resistance to shrinkage with washing and resistance to deterioration of strength, and having good hand.

SUMMARY OF THE INVENTION

It is an object of the present invention to provide a method for pattern dyeing of the textile fabrics containing blends of cellulose regenerated fiber capable of dyeing with cationic dyes and containing an insoluble polymer which is obtained by cross-linking a dihydroxydiphenylsulfone-sulfate condensate with epoxy compounds having at least two epoxy groups in the molecule, and other fibers by dyeing in one-bath to obtain the sprinkly pattern, dungaree pattern, chambray pattern, check pattern, or stripy pattern. It is further object of the present invention to provide a method for pattern dyeing of the textile fabrics to give them good color fastness, good wash-and-wear properties, and good hand without deterioration of strength and without shrinkage with washing and ironing.

The first aspect of the present invention resides in a method for pattern dyeing of the textile fabrics containing blends of cellulose regenerated fiber modified by an insoluble polymer which is obtained by cross-linking a dihydroxydiphenylsulfone-sulfate condensate with epoxy compounds having at least two epoxy groups in the molecule, and other fibers. The method comprises dyeing the textile fabrics with a dyeing solution containing cationic dyes alone or containing cationic dyes and dyes other than cationic dyes by one-bath dyeing method to obtain the sprinkly pattern, dungaree pattern, chambray pattern, check pattern, or stripy pattern. According to the second aspect of the present invention the step of the pattern dyeing method is followed by sequential treatment with an aqueous solution of tannic acid for applying tannic acid 1.5–7% of the weight of the modified cellulose regenerated fiber, and after that with an aqueous solution of tartar emetic for supplying tartar emetic 0.5–2.5% of the weight of the modified cellulose regenerated fiber. According to the third aspect of the present invention, the steps of the pattern dyeing method are followed by further treatment for cross-linking with resins reactive to cellulose.

The present invention provides the method for pattern dyeing of the textile fabric containing modified cellulose regenerated fiber which is superior in color fastness for cationic dyes, dyefixing, dyeability without deformation, soiling of undyed parts, blurring, washability without shrinkage, and deterioration of strength and hand.

DETAILED DESCRIPTION OF PREFERRED EMBODIMENTS

The present invention employs the term "textile fabrics containing specific modified cellulose regenerated fiber"

which embraces woven or knitted products formed from modified cellulose regenerated fiber capable of dyeing with cationic dyes and at least one kind of fiber selected from ordinary cellulose regenerated fiber, cotton, and wool. They may be produced from previously prepared blended yarn or twisted union yarn or may be in the form of union fabrics from individual spun yarns. The content of modified cellulose regenerated fiber in the textile fabric is not specifically restricted, and it may be established adequately according to the desired pattern and color.

The modified cellulose regenerated fiber used in the present invention may be produced by either the viscose process (including polynosic) or the cuprammonium process. It may be incorporated with an inorganic pigment (such as titanium dioxide) for delustering.

The modified cellulose regenerated fiber may be rendered dyeable with cationic dyes by incorporating the cellulose viscose solution etc., immediately before spinning, with a compound having anionic groups such as an insoluble polymer which is obtained by cross-linking a dihydroxydiphenylsulfone-sulfonate condensate with epoxy compounds having at least two epoxy groups in the molecule.

The insoluble polymer which is obtained by cross-linking a dihydroxydiphenylsulfone-sulfonate condensate with epoxy compounds having at least two epoxy groups in the molecule, is obtained, in the form of aqueous dispersion, by the process disclosed by the present applicant in Japanese Patent Laid-open No. 158263/1996. This process consists of cross-linking a dihydroxydiphenyl-sulfone-sulfonate condensate (represented by the formula 1) with one or more than one kind of polyfunctional epoxy compounds in a slightly basic aqueous solution of pH 7.5–10 at 30–90° C. for 4–12 hours.

Formula 1

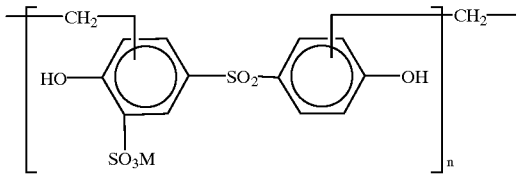

(Where M denotes a monovalent metal atom such as sodium and potassium, and n is an integer of 2 to 20.)

Examples of the polyfunctional epoxy compounds include sorbitol polyglycidyl ether, pentaerythritol polyglycidyl ether, glycerol polyglycidyl ether, resorcin diglycidyl ether, 1,6-hexanediol diglycidyl ether, ethyleneglycol diglycidyl ether, and neopentylglycol diglycidyl ether, etc.

Incidentally, the dihydroxydiphenylsulfone-sulfonate condensate and the epoxy compound as a cross-linking agent should be used in a ratio of from 1:1 to 1:3 in terms of the hydroxyl equivalent of the former and the epoxy equivalent of the latter. In the case where more than two epoxy compounds are used, the epoxy equivalent is in terms of the total value of their individual epoxy equivalents. The amount of the insoluble polymer in the viscose solution should be 5–50 wt %, preferably 10–40 wt %, of the weight of cellulose. Its adequate amount should be established in consideration of color yield of cationic dyes and fiber tenacity.

And it is preferable because it can be dyed, like cellulose fiber, with direct dyes or reactive dyes.

The pattern dyeing method according to the present invention consist of dyeing the textile fabric which is dyeable with cationic dyes alone or in combination with dyes other than cationic dyes by the one-bath dyeing. For dyes other than cationic dyes, direct dyes and reactive dyes are preferable. The dyeing is intended to obtain the sprinkly pattern, dungaree pattern, chambray pattern, check pattern, or stripy pattern. Dyeing is followed by washing. In the case where it is desirable to dye modified cellulose regenerated fiber and leave other fiber undyed, dyeing may be accomplished by using cationic dyes alone. In the case where it is desirable to dye both modified cellulose regenerated fiber and other fiber, dyeing may be accomplished by using dyes solution containing cationic dyes and direct dyes or reactive dyes, and dyeing is following by washing.

The concentration of each dye varies depending on the color desired. An adequate amount of cationic dyes should be established on the basis of the weight of modified cellulose regenerated fiber, because cationic dyes are picked up by modified cellulose regenerated fiber. An adequate amount of direct dyes and/or reactive dyes should be established on the basis of the total weight of textile fabric, because direct dyes and/or reactive dyes are picked up by all kinds of fiber.

The present invention is followed by sequential treatment with an aqueous solution of tannic acid, and after that with an aqueous solution of tartar emetic. This treatment is designed to improve the color fastness. Therefore, the specified order of treatment should be observed and the two aqueous solutions should be used sequentially; otherwise, the dye will not be firmly fixed to the fiber.

The aqueous solution of tannic acid is usually adjusted to pH 3–6, preferably pH 4–5, with acetic acid. The concentration of tannic acid to be picked up by the dyed fiber is usually 1.5–7 wt %, preferably 2–6 wt %, of the weight of the dyed modified cellulose regenerated fiber. With the concentration less than 1.5 wt %, the tannic acid does not produce the desired color fastness. With the concentration in excess of 7 wt %, tannic acid causes the cationic dyes fixed to the modified cellulose regenerated fiber to soil the undyed fiber. The treatment should be carried out at 30–90° C., preferably 50–70° C., for 10–60 minutes, preferably 20–40 minutes. Since the concentration of cationic dyes is decided for the modified cellulose regenerated fiber weight used to the textile fabric, substantially all cationic dyes are fixed to the fibers. So, the inconvenience that cationic dyes stain the tannic acid aqueous solution can be completely resolved and clear dyed color of the textile fiber is maintained. The treatment with an aqueous solution of tannic acid is followed by washing and then treatment with an aqueous solution of tartar emetic adjusted to pH 3–6, preferably pH 4–5, with acetic acid.

The treatment with an aqueous solution of tartar emetic is intended to cause tannic acid to firmly adhere to the dyed fiber. The concentration of tartar emetic to be picked up by the dyed modified cellulose regenerated fiber should be usually 0.5–2.5 wt %, preferably 0.75–2 wt %, of the weight of the dyed fiber. The treatment should be carried out at 30–90° C., preferably 50–70° C., for 10–60 minutes, preferably 20–40 minutes. The treatment with an aqueous solution of tartar emetic is followed by washing and then drying at 80–120° C.

If necessary following the above-mentioned treatments, the obtained fabric optionally undergoes treatment for cross-linking with resins reactive to cellulose for reduction of shrinkage with washing and pressing and for improvement in wash-and-wear properties. This treatment brings about cross-linking between tannic acid and cellulose molecule and between cellulose molecules. Such resins include, for example, N-methylol compounds such as dimethylol ethylene urea, dimethylol dihydroxyethylene urea, dimethylol alkyl-carbamate, methylated dimethylol dimethoxy ethylene urea, etc., epoxy compounds such as polyalkylene glycol diglycidyl ether, glycerine diglycidyl ether, etc. isocyanate compounds such as hexamethylene diisocyanate, diphenylmethane diisocyanate, etc. and vinylsulfone derivatives typified by bis-(β-hydroxyethyl) sulfone. If necessary, the resin may be used in combination with a catalyst, softener, strength improver, hand adjustor, etc.

Of these examples, N-methylol compounds are preferable because other compounds have their disadvantages given below. Epoxy compounds are not so stable when stored in the form of solution containing a catalyst. In addition, they cause discoloration to the dyed product when they are used in combination with metal borofluoride as a catalyst. Isocyanate compounds tend to cause discoloration with the lapse of time and heating. In addition, they are comparatively expensive and hence uneconomical. Vinylsulfone derivatives lower the strength of the dyed product and need an alkaline catalyst and heat which oxidize cellulose to form polyoxycarboxylic acid derivatives. This makes it necessary to subject the dyed product in bright light color to bleaching after finishing.

The amount of the resin may be determined according to the application of the textile fabric to be dyed and finished. It is usually 2–6 wt %, preferably 2.5–4 wt %, of the weight of the textile fabric in consideration of color fastness with cationic dyes, washing shrinkage, tear strength, and burst strength. Treatment is usually carried out by the pad-dry-cure method so that the resin is completely impregnated into the textile fabric. After treatment, the textile fabric is squeezed by rolling with a pickup of 70–80% and then dried at 80–120° C. and dry-heated at 130–180° C.

The duration of heat treatment is not specifically restricted so long as it is long enough for cross-linking to take place sufficiently. It may be properly established according to the unit area weight of the textile fabric. Then the resin-treated textile fabric undergoes soaping, washing, drying, and optional oil treatment in the usual way. The resin treatment will not leach out the dye from the dyed fabric on account of the treatment with tannic acid and tartar emetic that precedes the resin treatment.

According to the present invention, it is possible to dye a textile fabric composed of specific modified cellulose regenerated fiber and any of ordinary cellulose regenerated fiber, cotton, and wool with cationic dyes alone or in combination with direct dyes or reactive dyes other than cationic dyes by the one-bath dyeing method, thereby obtaining the sprinkly pattern, dungaree pattern, chambray pattern, check pattern, or stripy pattern by their desired pattern. The modified cellulose regenerated fiber acquires the dyeability with cationic dyes because it contains an insoluble polymer which is obtained by cross-linking a dihydroxydiphenylsulfone-sulfonate condensate with epoxy compounds having at least two epoxy groups in the molecule.

And after dyeing with cationic dyes, the modified cellulose regenerated fiber firmly catches tannic acid if it is treated sequentially with an aqueous solution of tannic acid and after that treated with an aqueous solution of tartar emetic. At the above treatment of cationic dyes dyeing, tannic acid aqueous solution and tartar emetic aqueous solution, the concentration of cationic dyes, amount of tannic acid and tartar emetic are decided for the modified cellulose regenerated fiber weight. If necessary, after dyeing and treatment with aqueous solution of tannic acid and aqueous solution of tartar emetic, the textile fabric containing modified cellulose regenerated fiber is improved in color fastness and wash-and-wear properties if it is treated with a cellulose-reactive resin.

The present invention provides the method for pattern dyeing of the textile fabric containing modified cellulose regenerated fiber which is superior in color fastness for cationic dyes, wash-and-wear properties, washability without shrinkage and deterioration of strength, hand, dye fixing, and dyeability without deformation, soiling of undyed parts, and blurring. The method of the present invention is suitable for pattern dyeing a large variety of products, each in small lots.

EXAMPLES

The invention will be described in more detail with reference to the following examples, which are not intended to restrict the scope of the invention. Using the test methods explained below, samples were tested for color fastness, shrinkage with washing, shrinkage with pressing, wash-and-wear properties, tear strength, burst strength, hand, dye fixing, and dyeability.

Color Fastness:

Rubbing (dry, wet): JIS L-0849-1971

Light: JIS L-0842-1988 (20 hours exposure)

Sweat (acidic, alkaline): JIS L-0848-1978, Method A

Washing: JIS L-0844-1986

Shrinkage with washing: JIS L-1042-1992,

Method F3 (tumbler, hanger drying)

Shrinkage with pressing: JIS L-1042-1992, Method H-3

Wash-and-wear properties: JIS L-1096-1979, 6.23,

Method A (tumbler drying)

Tear strength: JIS L-1096-1979, 6.15.5, Method D

Burst strength: JIS L-1018-1990, Method A (Mullen-type)

Hand: sensory test by five panelists

⊙ (Superior): all of five panelists agree

○ (Good): 4 or 3 panelists agree

Δ (Poor): 2 or I panelist agrees x (Very Poor): none of five panelists agree

Dye fixing: The color of the resin solution before treatment is compared with that after treatment by sensory test by five panelists.

⊙ (Superior): all panelists recognize no color change

○ (Good): 4 or 3 panelists recognize no color change

Δ (Poor): 2 or 1 panelist recognizes no color change x (Very Poor): all panelists recognize color change Dyeability: sensory test by five panelists for staining, deformation of pattern, uneven dyeing, and blurring.

⊙ (Superior): all panelists agree

○ (Good): 4 or 3 panelists agree

Δ (Poor): 2 or I panelist agrees x (Very Poor): none of panelists agree

EXAMPLE 1

Dihydroxydiphenylsulfone-sulfonate was prepared by adding sodium hydroxide to 400 weight parts of an aqueous solution of dihydroxydiphenyl-sulfonate condensate ("Nylox 1500", 40% active ingredient, from lpposha Yushi Kogyo Co., Ltd.). To the dihydroxydiphenylsulfone-sulfonate was added for cross-linking 55 weight parts of resorcin diglycidyl ether ("Denacol EX-201", having an epoxy equivalent of 118, from Nagase Kasei Co., Ltd.), and 65 weight parts of neopentylglycol diglycidyl ether ("Denacol EX-211", having an epoxy equivalent of 140, from Nagase Kasei Co., Ltd.). The amount of the cross-linking agents is such that the hydroxyl equivalent of the dihydroxydiphenylsulfone-sulfonate condensate matches the total epoxy equivalents of the cross-linking agents.

After adding water, the mixture of dihydroxyphenylsulfone-sulfonate condensate and cross-linking agents was thoroughly dispersed by using a homogenizer, and the aqueous dispersion was adjusted to pH 8.0 with sodium hydroxide. The total amount of added water and sodium hydroxide was 479 weight parts. The aqueous dispersion was stirred at 50° C. for 6 hours to give an aqueous dispersion of a cross-linked polymer of Dihydroxydiphenylsulfone-sulfonate condensate.

This aqueous solution was added to polynosic viscose obtained in the usual way immediately before spinning such that it accounts for 40 wt % of the weight of cellulose. After usually spinning, there was obtained modified polynosic fiber, 1.25 denier, 38 mm.

The modified polynosic fiber was mixed-spun with ordinary polynosic fiber (1.25 denier, 38 mm) in a mixing ratio of 30% to 70% to give a blended yarn (40'$^s$). The blended yarn was woven into a plain weave fabric (110 warps/inch and 75 wefts/inch). The plain weave fabric underwent gassing, desizing, scouring, bleaching, mercerizing, washing, and drying in the usual way.

The plain weave fabric was placed in a jet dyeing machine and dyed with a dyeing solution, as specified below, at 100° C. for 40 minutes, with the fabric and a dyeing solution ratio being 1:30.

Composition of the Dyeing Solution:

- Blue cationic dye ("Astrazen Blue F2RL", from Hodogaya Kagaku Kogyo Co., Ltd.), 1.5% owf (for modified polynosic fiber)
- Orange cationic dye ("Cathilon Orange RH Liq", from Hodogaya Kagaku Kogyo Co., Ltd.), 1.3% owf (for modified polynosic fiber)
- Yellow cationic dye ("Cathilon Yellow 3GLH", from Hodogaya Kagaku Kogyo Co., Ltd.), 0.8% owf (for modified polynosic fiber)
- Sodium laurylsulfate, 1% owf (for modified polynosic fiber)
- Dispersing agent ("Daidesupaa X-45", from lpposha Yushi Kogyo Co., Ltd.), 2% owf (for modified polynosic fiber)
- Acetic acid: 0.5 g/L
- Sodium acetate: 0.25 g/L
- pH 4.0

Dyeing was followed by washing and drying. Thus there was obtained a plain weave fabric of sprinkly pattern, with the modified polynosic fibers alone dyed in black. It is designated as Sample No.1.

The above-mentioned modified polynosic fiber was mixed-spun with ordinary polynosic fiber and wool (Wool Bumptop (66'), 38 mm) in a mixing ratio of 45%, 25%, and 30%, to give a blended yarn (30'$^s$) The blended yarn was knitted into a knitted fabric by using a single circular knitting machine (26 inches, 28 gauge, 2088 needles) made by Fukuhara Seiki Co., Ltd.

The knitted fabric was placed in a jet dyeing machine and scoured and bleached with a solution as specified below, at 95° C. for 30 minutes, with the fabric and a dyeing solution ratio being 1:30.

Composition of the Solution:

- Hydrogen peroxide (35%): 4 g/L
- Stabilizer ("Haipaa" from Daito Yakuhin Co., Ltd.): 1 g/L
- Sodium carbonate: 2 g/L
- Penetrating agent ("Daisaafu P-30" from Dai-ichi Kogyo Seiyaku Co., Ltd.): 0.5 g/L The scouring and bleaching step was followed by washing and drying.

After that, the obtained fabric was dyed with a dyeing solution as specified below, at 100° C. for 40 minutes, with the fabric and a dyeing solution ratio being 1:30.

Composition of the Dyeing Solution:

- Red cationic dye ("Astra Phloxine FF conc", from Hodogaya Kagaku Kogyo Co., Ltd.), 0.25% owf (for modified polynosic fiber)
- Yellow cationic dye ("Cathilon Yellow 7GLH", from Hodohaya Kagaku Kogyo Co., Ltd.), 0.5% owf (for modified polynosic fiber)
- Sodium laurylsulfate, 1% owf (for modified polynosic fiber)
- Dispersing agent ("Daidesupaa X-45", from lpposha Yushi Kogyo Co., Ltd.), 2% owf (for modified polynosic fiber)
- Acetic acid: 0.5 g/L
- Sodium acetate: 0.25 g/L
- pH 4.0

Dyeing was followed by washing and drying. Thus there was obtained a knitted fabric of sprinkly pattern, with the modified polynosic fibers alone dyed in red. It is designated as Sample No.2.

The above-mentioned modified polynosic fiber was spun into spun yarn (50'$^s$). The modified polynosic fiber yarn and ordinary polynosic fiber yarn (50'$^s$) were woven into a plain weave fabric, with 144 warps and 82 wefts per inch. Ten yarns of each kind were arranged alternately in both warps and wefts. The plain weave fabric underwent gassing, desizing, scouring, bleaching, mercerizing, washing, and drying in the usual way.

The plain weave fabric was placed in a jet dyeing machine and dyed with a dyeing solution as specified below, at 100° C. for 40 minutes, with the fabic and a dyeing solution ratio being 1:30.

Composition of the Dyeing Solution:

- Blue cationic dye ("Astrazen Blue F2RL" 200%, from Hodogaya Kagaku Kogyo Co., Ltd.), 1.2% owf (for modified polynosic fiber yarns)
- Yellow direct dye ("Kayarus Supra Yellow GSL", from Nippon Kayaku Co., Ltd.), 0.2% owf
- Sodium laurylsulfate, 1% owf (for modified polynosic fiber yarns)
- Dispersing agent ("Daidesupaa X-45", from lpposha Yushi Kogyo Co., Ltd.), 2% owf (for modified polynosic fiber yarns)
- Acetic acid: 0.5 g/L
- Sodium acetate: 0.25 g/L
- Sodium sulfate: 10 g/L
- pH 4.0

Dyeing was followed by washing and drying. Thus there was obtained a plain weave fabric of check pattern, with the modified polynosic yarns dyed in marine blue with the cationic dye and direct dye and the polynosic fiber yarns dyed in light yellow with direct dye. It is designated as Sample No.3.

The modified polynosic fiber yarn (50'$^s$) and cotton spun yarn (50'$^s$) were woven into a plain weave fabric, with 144 warps and 82 wefts per inch. Ten yarns of each kind were arranged alternately in both warps and wefts. The plain weave fabric underwent gassing, desizing, scouring, bleaching, mercerizing, washing, and drying in the usual way.

The plain weave fabric was dyed with a dyeing solution as specified below, at 100° C. for 40 minutes, with the fabric and a dyeing solution ratio being 1:30.

Composition of the Dyeing Solution:

- Blue cationic dye ("Catchilon Blue F2RL" 200%, from Hodogaya Kagaku Kogyo Co., Ltd.), 1.2% owf (for modified polynosic fiber yarns)
- Red reactive dye ("Kayaselon React Red CN-3B", from Nippon Kayaku Co., Ltd.), 0.2% owf
- Buffer ("Kayaku Buffer AC", from Nippon Kayaku Co., Ltd.), 1.5 g/L
- Sodium laurylsulfate, 1% owf (for modified polynosic fiber yarns)
- Dispersing agent ("Daidesupaa X-45", from Ipposha Yushi Kogyo Co., Ltd.), 2% owf (for modified polynosic fiber yarns)
- Acetic acid: 0.5 g/L
- Sodium acetate: 0.25 g/L
- Sodium sulfate: 20 g/L
- pH 4.0

Dyeing was followed by washing and drying. Thus there was obtained a plain weave fabric of check pattern, with the modified polynosic fiber yarns dyed in blue with the cationic dye and reactive dye and the cotton yarns dyed in light pink with reactive dye. It is designated as Sample No. 4. The samples Nos. 1 to 4 were tested for dyeability. The results are shown in Table 1. On the following tables: ⊛ =superior; ○=good; Δ=poor; x =very poor.

TABLE 1

| Sample | 1 | 2 | 3 | 4 |
|---|---|---|---|---|
| Dyeability | ⊛ | ⊛ | ⊛ | ⊛ |

It is noted from Table I that the textile fabric containing modified polynosic fiber yarn or spun yarn are readily dyed by the one-bath dyeing method without uneven dyeing, staining, and blurring when dyed with a dyeing solution containing a cationic dye alone or a cationic dye in combination with a direct dye or reactive dye other than cationic dyes. In other words, all the samples are superior in dyeability and capable of cross dyeing.

EXAMPLE 2

Seven samples of woven fabrics with a sprinkly pattern were prepared by dying in the same manner as for Sample No. 1 in Example 1. Each of them was treated with an aqueous solution containing tannic acid in different concentration as specified below, adjusted to pH 4.0 with acetic acid, at 70° C. for 30 minutes, with the fabric and a dyeing solution ratio being 1:30. This treatment was followed by washing. Concentration of tannic acid in the treating solution: 1.0%, 1.5%, 2.0%, 5.0%, 6.0%, 7.0%, 8.0% owf for the modified polynosic fiber. Each of the treated samples was further treated with an aqueous solution containing tartar emetic in different concentration as specified below, adjusted to pH 4.0 with acetic acid, at 70° C. for 30 minutes, with the fabric and a dyeing solution ratio being 1:30. This treatment was followed by washing and drying. Concentration of tartar emetic in the treating solution 0.3% 0.5% 0.75% 1.5% 2.0%, 2.5%, 3.0% owf for the modified polynosic fiber Thus there were obtained Samples Nos. 1-1 to 1-7 which carry tannic acid and tartar emetic. They were tested for color fastness and dyeability. The results are shown in Table 2.

TABLE 2

| Item | Sample 1–1 | 1–2 | 1–3 | 1–4 | 1–5 | 1–6 | 1–7 |
|---|---|---|---|---|---|---|---|
| Concentration of Tannic acid (% owf) | 1.0 | 1.5 | 2.0 | 5.0 | 6.0 | 7.0 | 8.0 |
| Concentration of Tannic emetic (% owf) | 0.3 | 0.5 | 0.75 | 1.5 | 2.0 | 2.5 | 3.0 |
| Color Fastness (class) | | | | | | | |
| Rubbing | | | | | | | |
| Dry | 3–4 | 4 | 4–5 | 4–5 | 4–5 | 4–5 | 5 |
| Wet | 3 | 3 | 3–4 | 3–4 | 3–4 | 3–4 | 4 |
| Light | 4 | 4 | 4–5 | 4–5 | 4–5 | 4 | 4 |
| Washing | 3–4 | 4 | 4–5 | 5 | 5 | 5 | 5 |
| Sweat | | | | | | | |
| Acidic | 4 | 4–5 | 5 | 5 | 5 | 5 | 5 |
| Alkaline | 4 | 4–5 | 5 | 5 | 5 | 5 | 5 |
| Dyeability | Δ | ○ | ⊛ | ⊛ | ⊛ | ○ | Δ |

It is noted from Table 2 that the treatment with tannic acid after dyeing and after that treatment with tartar emetic impart good color fastness and dyeability to the modified polynosic fiber when the concentration of tannic acid solution is 1.5–7% owf and tartar emetic solution is 0.5–2.5% owf, respectively, for the modified polynosic fiber.

EXAMPLE 3

Six samples of woven fabrics with a sprinkly pattern were prepared by dyeing and subsequent treatment with tannic acid and tartar emetic in the same manner as for Sample No. 1-4 in Example 2. The first of them was treated with a finishing solution as specified below by padding, with the pickup yield being 70%.

Composition of the Finishing Solution:

- N-methylol compound ("Riken Resin RG-10E", 50% active ingredient, from Miki-Riken Kogyo Co., Ltd.): 80 g/L
- Catalyst ("Riken Fixer MX-18", from Miki-Riken Kogyo Co., Ltd.): 25 g/L
- Silicone softening agent ("Raitosirikon A-544", from Kyoeisha Kagaku Co., Ltd.): 50 g/L
- Polyolefin softening agent ("Mabozoru P0", from Matsumoto Yushi Seiyaku Co., Ltd.): 20 g/L This treatment was followed by drying at 120 for 1 minute and heat treatment at 165° C. for 1.5 minutes. Thus there was obtained a finished plain weave fabric having a sprinkly pattern. It is designated as Sample No.1-4-1.

The above-mentioned pattern dyeing process consists of treatment with an aqueous solution of tannic acid, treatment with an aqueous solution of tartar emetic, and treatment with resin, which are performed sequentially. For the purpose of comparison, five samples were prepared in the same manner as above except that any one or two of the three treatments were omitted or the order of the treatments was changed as follows.

Sample No. 1-4-2: no treatments with tartar emetic and resin.

Sample No. 1-4-3: no treatment with tartar emetic.

Sample No. 1-4-4: with the order of treatments changed as follows: sequential treatments with tartar emetic→tannic acid→resin.

Sample No. 1-4-5: with the order of treatments changed as follows: simultaneous treatment with mix solution of tannic acid and tartar emetic and subsequent treatment with resin.

Sample No. 1-4-6: with the order of treatments changed as follows: sequential treatments with resin→tannic acid→tartar emetic.

Samples Nos. 1-4-1 to 1-4-6 were tested for color fastness, shrinkage with washing and pressing, wash-and-wear properties, tear strength, hand, dye fixing, and dyeability. The results are shown in Table 3.

TABLE 3

| | Sample | | | | | |
|---|---|---|---|---|---|---|
| | Example | Comparative Example | | | | |
| Item | 1–4–1 | 1–4–2 | 1–4–3 | 1–4–4 | 1–4–5 | 1–4–6 |
| Concentration of Tannic acid (% owf) | 5 | 5 | 5 | 5 | 5 | 5 |
| Concentration of Tartar emetic (% owf) | 1.5 | 0 | 0 | 1.5 | 1.5 | 1.5 |
| Resin concentration (g/L) | 80 | 0 | 80 | 80 | 80 | 80 |
| Amount of fixed resin (% owf) | 2.8 | 0 | 2.8 | 2.8 | 2.8 | 2.8 |
| Dye fixing | ⊛ | — | Δ | Δ | Δ | X |
| | | Color fastness (class) | | | | |
| Rubbing | | | | | | |
| Dry | 5 | 3 | 3–4 | 3–4 | 3–4 | 3–4 |
| Wet | 4 | 3 | 3–4 | 3–4 | 3–4 | 3–4 |
| Light | 4–5 | 3 | 3–4 | 3–4 | 3–4 | 3–4 |
| Washing | 5 | 3 | 3–4 | 3–4 | 3–4 | 3–4 |
| Sweat | | | | | | |
| Acidic | 5 | 3 | 3–4 | 3–4 | 3–4 | 3–4 |
| Alkaline | 5 | 3 | 3–4 | 3–4 | 3–4 | 3–4 |
| Shringkage with washing (tumbler) (%) | | | | | | |
| Warp | 1.48 | 3.16 | 1.52 | 1.50 | 1.49 | 1.48 |
| Weft | +2.43 | +4.31 | +2.40 | +2.45 | +2.41 | +2.51 |
| Shrinkage with pressing (%) | | | | | | |
| Warp | 0.4 | 1.3 | 0.5 | 0.5 | 0.4 | 0.4 |
| Waft | +0.4 | +2.0 | +0.5 | +0.4 | +0.5 | +0.5 |
| Wash-and-wear properties (class) | 4 | 1 | 4 | 4 | 4 | 4 |
| Tear strength (g) | | | | | | |
| Warp | 2420 | 2730 | 2400 | 2380 | 2410 | 2390 |
| Weft | 1400 | 1680 | 1420 | 1450 | 1380 | 1410 |
| Hand | ⊛ | ○ | ⊛ | ⊛ | ⊛ | ⊛ |
| Dyeability | ⊛ | ⊛ | ○ | ○ | ○ | Δ |

The following is noted from Table 3. Sample No. 1-4-2 is poor in color fastness, shrinkage with washing and pressing, wash-and-wear properties, hand, and dyeability because of the omission of treatments with tartar emetic and resin. Samples Nos. 1-4-3 to 1-4-5 are poor in dye fixing, color fastness, and dyeability. Sample No. 1-4-6 is very poor in dye fixing and slightly poor in color fastness and dyeability. By contrast, Sample No. 1-4-1 conforming to the present invention is superior in dye fixing owing to the sequential treatments with tannic acid and tartar emetic and is also superior in color fastness, shrinkage with washing and pressing, wash-and-wear properties, tear strength, burst strength, hand, and dyeability owing to the treatment with resin.

EXAMPLE 4

A knitted fabric of sprinkly pattern was prepared in the same manner as for Sample No. 2 in Example 1. The knitted fabric was treated at 70° C. for 30 minutes with an aqueous solution containing tannic acid, 5% owf (for modified polynosic fiber), adjusted to pH 4.0 with acetic acid, with the fabric and a tannic acid solution ratio being 1:30. The treatment was followed by washing. The fabric was further treated at 70° C. for 30 minutes with an aqueous solution of tartar emetic, 1.5% owf (for modified polynosic fiber), adjusted to ph 4.0 with acetic acid, with the knitted fabric and a tartar emetic solution ratio being 1:30. The treatment was followed by washing and drying. The knitted fabric was then treated with a finishing solution as specified below by padding, with the pickup yield being 80%.

Composition of the Finishing Solution:

- N-methylol compound ("Sumitex Resin NS-10", 45% active ingredient, from Sumitomo Chemical Industry Co., Ltd.): 100 g/L
- Catalyst based on magnesium chloride-chlorine complex ("Sumitex Accelerator X-80", from Sumitomo Chemical Industry Co., Ltd.): 30 g/L
- Aminosilicone softening agent ("Nikkasirikon AM-202", from Nikka Kagaku Co., Ltd.): 20 g/L
- Polyethylen softening agent ("Yodozoru PE-400", from Kanebo NSC Co., Ltd.): 15 g/L
- Formalin catcher ("Faidekkusu FCK", from Dainippon Ink & Chemicals, Inc.): 5 g/L This treatment was followed by drying at 120° C. for 1 minute and heat treatment at 165° C. for 1.5 minutes. After oiling there was obtained a finished knitted fabric. It is designated as Sample No. 2-1. This sample was tested for color fastness, shrinkage with washing, wash-and-wear properties, tear strength, hand, dye fixing, and dyeability. The results are shown in Table 4.

TABLE 4

| Item | Sample 2–1 |
|---|---|
| Concentration of tannic acid (% owf) | 5 |
| Concentration of tartar emetic (% owf) | 1.5 |
| Resin concentration (g/L) | 100 |
| Amount of fixed resin (% owf) | 3.6 |
| Dye fixing | ⊛ |
| Color fastness (class) | |
| Rubbing | |
| Dry | 5 |
| Wet | 4 |
| Light | 4 |
| Washing | 5 |
| Sweat | |
| Acidic | 5 |
| Alkaline | 5 |
| Shrinkage with washing (tumbler) (%) | |
| Warp | 5.3 |
| Weft | 7.3 |
| Shrinkage with washing (%) (drying by hanging) | |
| Warp | 1.7 |
| Weft | 4.7 |
| Wash-and-wear properties (class) | 4.5 |
| Burst strength (kg/m$^2$) | 4.8 |
| Hand | ⊛ |
| Dyeability | ⊛ |

It is noted from Talbe 4 that Sample No. 2-1 is Superior in dye fixing owing to the sequential treatments with tannic acid and after that treatment with tartar emetic and is also superior in color fastness, shrinkage with washing, wash-and-wear properties, tear strength, hand, and dyeability owing to the treatment with resin.

Example 5.

Five rolls of the dyed plain weave fabric with check pattern as Sample No. 3 in Example 1 were treated at 70° C. for 30 minutes with an aqueous solution containing tannic acid, 5% owf (for modified polynosic fiber yarns), adjusted to pH 4.0 with acetic acid, with the fabric and a tannic acid solution ratio being 1:30. The treatment was followed by washing. The fabric was further treated at 70° C. for 30 minutes with an aqueous solution of tartar emetic, 1.5% owf (for modified polynosic fiber yarns), adjusted to pH 4.0 with acetic acid, with the fabric and a tartar emetic solution ratio being 1:30. The treatment was followed by washing and drying. Thus there were obtained five rolls of plain weave fabric with a check pattern which were treated with tannic acid and tartar emetic after dyeing.

Five kinds of resin treating solutions were prepared according to the following formulation.

N-methylol compound ("Sumltex Resln NS-10", 45% active ingredient, from Sumitomo Chemical Industry Co., Ltd.) 63.5 g/L, 80 g/L, 90 g/L, 127 g/L, and 190 g/L Catalyst based on magnesium chloride-chlorine complex ("Sumitex Accelerator x-80", from Sumitomo Chemical Industry Co., Ltd.): 30 g/L Aminosilicone softening agent ("Nikkasirikon AM-202", from Nikka Kagaku Co., Ltd.): 20 g/L Polyethylen softening agent ("Yodozoru PE-400", from Kanebo NSC Co., Ltd.): 15 g/L Formalin catcher ("Faindekkusu FCK", from Dainippon Ink & Chemicals, Inc.): 5 g/L Each roll of the above-mentioned plain weave fabrics was treated with the above mentioned resin solution by padding, with the pickup yield being 70%. This treatment was followed by drying at 120° C. for 1 minute and heat treatment at 165° C. for 1.5 minutes and oiling. Thus there were obtained samples of finished plain weave fabrics with a check pattern. They are designated as Samples Nos. 3-1 to 3-5.

These samples were tested for color fastness, shrinkage with washing and pressing, wash-and-wear properties, tear strength, dye fixing, hand, and dyeability. The results are shown in Table 5.

TABLE 5

| Item | Sample 3–1 | 3–2 | 3–3 | 3–4 | 3–5 |
|---|---|---|---|---|---|
| Concentration of tannic acid (% owf) | 5 | 5 | 5 | 5 | 5 |
| Concentration of tartar emetic (% owf) | 1.5 | 1.5 | 1.5 | 1.5 | 1.5 |
| Resin concentration (g/L) | 63.5 | 80 | 95 | 127 | 190 |
| Amount of fixed resin (% owf) | 2.0 | 2.5 | 3.0 | 4.0 | 6.0 |
| Dye fixing | ⊛ | ⊛ | ⊛ | ⊛ | ⊛ |
| Color fastness (class) | | | | | |
| Rubbing | | | | | |
| Dry | 5 | 5 | 5 | 5 | 5 |
| Wet | 4 | 4 | 4 | 4 | 4 |

TABLE 5-continued

| Item | Sample 3–1 | 3–2 | 3–3 | 3–4 | 3–5 |
|---|---|---|---|---|---|
| Light | 4–5 | 4–5 | 4–5 | 4–5 | 4–5 |
| Washing | 5 | 5 | 5 | 5 | 5 |
| Sweat | | | | | |
| Acidic | 5 | 5 | 5 | 5 | 5 |
| Alkaline | 5 | 5 | 5 | 5 | 5 |
| shrinkage with washing (tumbler) (%) | | | | | |
| Warp | 2.12 | 1.80 | 1.73 | 1.13 | 0.98 |
| Weft | +2.90 | +2.73 | +2.68 | +2.21 | +2.10 |
| Shrinkage with pressing (%) | | | | | |
| Warp | 0.9 | 0.7 | 0.6 | 0.3 | 0.2 |
| Weft | +1.0 | +0.8 | +0.7 | +0.4 | +0.4 |
| Wash-and-wear Properties (class) | 3 | 3.5 | 4 | 4 | 4.5 |
| Tear strength (g) | | | | | |
| Warp | 2370 | 2270 | 2260 | 2300 | 2180 |
| Weft | 1350 | 1300 | 1230 | 1130 | 1020 |
| Hand | ○ | ⊛ | ⊛ | ⊛ | ○ |
| Dyeability | ⊛ | ⊛ | ⊛ | ⊛ | ⊛ |

It is noted from Table 5 that the plain weave fabric composed of modified polynosic fiber yarn and ordinary polynosic fiber yarn as arranged 10 yarns each alternately in both warps and wefts was capable of cross dyeing with a cationic dye and a direct dye. Treatment with tannic acid (5% owf) and tartar emetic (1.5% owf) for modified polynosic fiber yarns improves the dye fixing. Furthermore, treatment with a cellulose-reactive resin (2–6% owf) improves the fabric in color fastness, shrinkage with washing, wash-and-wear properties, hand, and dyeability. Sample No. 3-1 is slightly poor in wash-and-wear properties because the amount of fixed resin is slightly small. Sample No. 3-5 is slightly poor in tear strength and hand because the amount of fixed resin is slightly large.

EXAMPLE 6

Five rolls of the same plain weave fabric as Sample No. 4 in Example 1 were treated at 70° C. for 30 minutes with an aqueous solution containing tannic acid, 5% owf (for modified polynosic fiber yarns), adjusted to pH 4.0 with acetic acid, with the fabric and a tannic acid solution ratio being 1:30. The treatment was followed by washing. The fabric was further treated at 70° C. for 30 minutes with an aqueous solution of tartar emetic, 1.5% owf (for modified polynosic fiber yarns), adjusted to pH 4.0 with acetic acid, with the fabric and a tartar emetic solution ratio being 1:30. The treatment was followed by washing and drying. Thus there were obtained five rolls of plain weave fabric with a check pattern which were treated with tannic acid and tartar emetic after dyeing.

Five kinds of resin treating solutions were prepared according to the following formulation.

N-methylol compound ("Riken Resin RG-10E", 50% active ingredient, from Miki Riken Kogyo Co., Ltd.): 57 g/L, 72 g/L, 86 g/L, I14 g/L, and 171 g/L Catalyst ("Riken Fixer MX-18", from Miki Riken Kogyo Co., Ltd.): 25 g/L Silicone softening agent ("Raitosirikon A-544", from Kyoeisha Kagaku Co., Ltd.): 50 g/L Polyolefin softening agent ("Mabozoru P0", from Matsumoto Yushi Seiyaku Co., Ltd.): 20 g/L Each roll of the above-mentioned plain weave fabrics was treated with the above mentioned resin solution by padding, with the pickup yield being 70%. This treatment was followed by drying at 120° C. for 1 minute and heat treatment at 165° C. for 1.5 minutes and oiling. Thus there were obtained samples of finished plain weave fabrics with a check pattern. They are designated as Samples Nos. 4-1 to 4-5.

These samples were tested for color fastness, shrinkage with washing and pressing, wash-and-wear properties, tear strength, dye fixing, hand, and dyeability. The results are shown in Table 6.

TABLE 6

| Item | Sample 4–1 | 4–2 | 4–3 | 4–4 | 4–5 |
|---|---|---|---|---|---|
| Concentration of tannic acid (% owf) | 5 | 5 | 5 | 5 | 5 |
| Concentration of tartar emetic (% owf) | 1.5 | 1.5 | 1.5 | 1.5 | 1.5 |
| Resin concentration (g/L) | 57.0 | 72 | 86 | 114 | 171 |
| Amount of fixed resin (% owf) | 2.00 | 2.52 | 3.01 | 3.99 | 5.99 |
| Dye fixing | ⊛ | ⊛ | ⊛ | ⊛ | ⊛ |
| Color fastness (class) | | | | | |
| Rubbing | | | | | |
| Dry | 5 | 5 | 5 | 5 | 5 |
| Wet | 4 | 4 | 4 | 4 | 4 |
| Light | 4–5 | 4–5 | 4–5 | 4–5 | 4–5 |
| Washing | 5 | 5 | 5 | 5 | 5 |
| Sweat | | | | | |
| Acidic | 5 | 5 | 5 | 5 | 5 |
| Alkaline | 5 | 5 | 5 | 5 | 5 |
| Shringkage with washing (tumbler) (%) | | | | | |
| Warp | 2.12 | 1.80 | 1.67 | 1.13 | 0.92 |
| Weft | +2.90 | +2.73 | +2.50 | +2.21 | +2.07 |
| Shrinkage with pressing (%) | | | | | |
| Warp | 0.9 | 0.7 | 0.5 | 0.3 | 0.2 |
| Weft | +1.0 | +0.8 | +0.6 | +0.4 | +0.4 |
| Wash-and-wear properties (class) | 3 | 3.5 | 4 | 4 | 4.5 |
| Tear strength (g) | | | | | |
| Warp | 2520 | 2410 | 2250 | 2300 | 2160 |
| Weft | 1460 | 1350 | 1220 | 1190 | 1060 |
| Hand | ⊛ | ⊛ | ⊛ | ⊛ | ○ |
| Dyeability | ⊛ | ⊛ | ⊛ | ⊛ | ⊛ |

It is noted from Table 6 that the plain weave Fabric composed of modified polynosic fiber yarn and ordinary polynosic fiber yarn as arranged 10 yarns each alternately in both warps and wefts was capable of cross dyeing with a cationic dye and a reactive dye. Treatment with tannic acid (5% owf ) and tartar emetic (1.5% owf ) for modified polynosic fiber yarns improves the dye fixing. Furthermore, treatment with a cellulose-reactive resin (2–6% owf) improves the fabric in color fastness, shrinkage with washing, wash-and-wear properties, hand, and dyeability. Sample No. 4-1 is slightly poor in wash-and-wear properties because the amount of fixed resin is slightly small. Sample No. 4-4 is slightly poor in tear strength and hand because the amount of fixed resin is slightly large.

EXAMPLE 7

The modified polynosic fiber yarns (50'$^{s}$) obtained in the same manner as in Example 1 and ordinary polynosic fiber yarn (50'$^{s}$) were woven into a plain weave fabric, with 144 warps and 82 wefts per inch. Ten yarns of each kind were arranged alternately in both warps and wefts. The plain weave fabric underwent gassing, desizing, scouring, bleaching, mercerizing, washing, and drying in the usual way.

The plain weave fabric was placed in a jet dyeing machine and dyed with a dyeing solution as specified below, at 100° C. for 40 minutes, with the fabric and a dyeing solution ratio being 1:30.

Composition of the Dyeing Solution:

Blue cationic dye ("Cathilon Blue 3GLH", from Hodogaya Kagaku Kogyo Co., Ltd.), 1.0% owf (for modified polynosic fiber yarns)

Sodium laurylsulfate, 1% owf (for modified polynosic fiber yarns)

Dispersing agent ("Daidesupaa X-45", from Ipposha Yushi Kogyo Co., Ltd.), 2% owf (for modified polynosic fiber yarns)

Acetic acid: 0.5 g/L

Sodium acetate: 0.25 g/L pH 4.0

Dyeing was followed by washing. Thus there was obtained a plain weave fabric of check pattern, with the modified polynosic fiber yarns dyed in turquoise blue and the ordinary polynosic fiber yarns remaining undyed.

The resulting fabric was treated at 70° C. for 30 minutes with an aqueous solution containing tannic acid, 2% owf (for modified polynosic fiber yarns), adjusted to pH 4.0 with acetic acid, with the fabric and a tannic acid solution ratio being 1:30. The treatment was followed by washing. The fabric was further treated at 70° C. for 30 minutes with an aqueous solution of tartar emetic, 0.75% owf (for modified polynosic fiber yarns), adjusted to pH 4.0 with acetic acid, with the fabric and a tartar emetic solution ratio being 1:30. The treatment was followed by washing and drying.

The fabric was treated with a resin solution of the following formulation, by padding, with the pickup yield being 80%.

N-methylol compound ("Riken Resin RG-10E", 50% active ingredient, from Miki Riken Kogyo Co., Ltd.): 100 g/L Catalyst ("Riken Fixer MX-18", from Miki Riken Kogyo Co., Ltd.): 25 g/L Silicone softening agent ("Raitosirikon A-544", from Kyoeisha Kagaku Co., Ltd.): 50 g/L Polyolefin softening agent ("Mabozoru P0", from Matsumoto Yushi Seiyaku Co., Ltd.): 20 g/L This resin treatment was followed by drying at 120° C. for 1 minute and heat treatment at 165° C. for 1.5 minutes and oiling. Thus there were obtained Sample No. 5. This sample was tested for color fastness, shrinkage with washing and pressing, wash-and-wear properties, tear strength, hand, dye fixing, and dyeability. The results are shown in Table 7.

TABLE 7

| Item | Sample 5 |
|---|---|
| Concentration of tannic acid (% owf) | 2 |
| Concentration of tartar emetic (% owf) | 0.75 |
| Resin concentration (g/L) | 100 |

TABLE 7-continued

| Item | Sample 5 |
|---|---|
| Amount of fixed resin (% owf) | 4.00 |
| Dye fixing | ⊛ |
| Color fastness (class) | |
| Rubbing | |
| Dry | 5 |
| Wet | 4 |
| Light | 4 |
| Washing | 5 |
| Sweat | |
| Acidic | 5 |
| Alkaline | 5 |
| shrinkage with washing (tumbler) (%) | |
| Warp | 1.67 |
| Weft | +2.32 |
| Shrinkage with pressing (%) | |
| Warp | 0.5 |
| Weft | +0.5 |
| Wash-and-wear properties (class) | 4 |
| Tear strength (g) | |
| Warp | 2210 |
| Weft | 1200 |
| Hand | ⊛ |
| Dyeability | ⊛ |

It is noted from Table 7 that the plain weave fabric composed of modified polynosic fiber yarn and ordinary polynosic fiber yarn was capable of cross dyeing with a cationic dye which dyes the former alone. Treatment with tannic acid (2% owf) and tartar emetic (0.75% owf) for modified polynosic fiber yarns improves the dye fixing. Furthermore, treatment with a cellulose-reactive resin (4% owf) improves the fabric in color fastness, shrinkage with washing, wash-and-wear properties, tear strength, hand, and dyeability.

EXAMPLE 8

The modified polynosic fiber obtained in Example 1 was made into spun yarn (20'$^{s}$). This spun yarn for warps and ordinary polynosic fiber yarn (20'$^{s}$) for wefts were woven into a twill weave fabric, with 105 warps and 58 wefts per inch. The twill weave fabric underwent gassing, desizing, scouring, bleaching, mercerizing, washing, and drying in the usual way.

The twill weave fabric was placed in a jet dyeing machine and dyed with a dyeing solution under the same conditions as in Example 7. Thus there was obtained a twill fabric of dungaree pattern, with the modified polynosic fiber yarns dyed in turquoise blue and the ordinary polynosic fiber yarns remaining undyed.

The twill fabric was treated with tannic acid and tartar emetic in the same manner as in Example 7, except that the concentration of tannic acid was changed from 2% owf to 6% owf and the concentration of tartar emetic was changed from 0.75% owf to 2% owf and the concentration of resin was changed from 100 g/L to 50 g/L. Thus there was obtained Sample No. 6, with the modified polynosic fiber yarns dyed alone in turquoise blue for the dungaree pattern.

This sample was tested for color fastness, shrinkage with washing and pressing, wash-and-wear properties, tear strength, hand, dye fixing, and dyeability. The results are shown in Table 8.

TABLE 8

| Item | Sample 6 |
|---|---|
| Concentration of tannic acid (% owf) | 6 |
| Concentration of tartar emetic (% owf) | 2 |
| Resin concentration (g/L) | 50 |
| Amount of fixed resin (% owf) | 2 |
| Dye fixing | ⊛ |
| Color fastness (class) | |
| Rubbing | |
| Dry | 5 |
| Wet | 4 |
| Light | 4 |
| Washing | 5 |
| Sweat | |
| Acidic | 5 |
| Alkaline | 5 |
| Shrinkage with washing (tumbler) (%) | |
| Warp | 2.40 |
| Weft | +3.00 |
| Shrinkage with pressing (%) | |
| Warp | 0.5 |
| Weft | +0.7 |
| Wash-and-wear properties (class) | 3.5 |
| Tear strength (g) | |
| Warp | 3200 and up |
| Weft | 3200 and up |
| Hand | ⊛ |
| Dyeability | ⊛ |

It is noted from Table 8 that the twill fabric composed of modified polynosic fiber yarns for warps and ordinary polynosic fiber yarns for wefts, and dyed in the dungaree pattern is superior in dye fixing, color fastness, shrinkage with washing and pressing, wash-andwear properties, tear strength, hand, and dyeability in case that the modified polynosic fiber yarns are dyed alone with a cationic dye by the one-bath dyeing method and the fabric is treated with tannic acid (6% owf) and tartar emetic (2% owf) for the modified polynosic fiber yarns and further treated with a cellulose-reactive resin (2% owf).

What is claimed is:

1. A method for pattern dyeing of textile fabrics which contain blends of cellulose regenerated fiber modified by an insoluble polymer which is obtained by cross-linking a dihydroxydiphenylsulfone-sulfonate condensate with epoxy compounds having at least two epoxy groups in the molecule, and at least one kind of fiber selected from ordinary cellulose regenerated fiber, cotton and wool, said method comprising steps of dyeing said textile fabrics with a dyeing solution containing cationic dyes alone or containing the cationic dyes and dyes other than cationic dyes by a one-bath dyeing method, concentration of said cationic dyes being decided for the modified cellulose regenerated fiber weight and concentration of said dyes other than cationic dyes being decided for whole weight of the textile fabric, treating the dyed textile fabric sequentially with an aqueous solution of tannic acid for applying tannic acid in an amount of 1.5–7% of the weight of the modified cellulose regenerated fiber, and after that treating it with an aqueous solution of tartar emetic for applying tartar emetic in an amount of 0.5–2.5% of the weight of the modified cellulose regenerated fiber.

2. Method for pattern dyeing of textile fabrics as claimed in claim 1, wherein said method further includes a step of treating the textile fabric which is dyed and treated by tannic acid and tartar emetic with resins reactive to cellulose.

3. A method for pattern dyeing of textile fabrics as claimed in claim 2, wherein said resins reactive to cellulose are N-methylol-based resins reactive to cellulose.

* * * * *